United States Patent [19]

Hunter

[11] 3,988,662

[45] Oct. 26, 1976

[54] VARIABLE FLUX-RESET FERRORESONANT VOLTAGE REGULATOR

[75] Inventor: Patrick L. Hunter, Columbus, Ohio

[73] Assignee: North Electric Company, Galion, Ohio

[22] Filed: Dec. 13, 1974

[21] Appl. No.: 532,471

[52] U.S. Cl. ..... 323/48; 323/60; 323/61

[51] Int. Cl.[2] ..... G05F 1/38; G05F 1/64

[58] Field of Search ..... 323/44 R, 60, 61, 50, 323/48, 49

[56] References Cited

UNITED STATES PATENTS

| | | | |
|---|---|---|---|
| 2,706,271 | 4/1955 | Fletcher | 323/60 X |
| 3,739,257 | 6/1973 | Hunter | 323/60 X |
| 3,824,449 | 7/1974 | Hase | 323/60 X |
| 3,904,954 | 9/1975 | Knudson | 323/61 |

FOREIGN PATENTS OR APPLICATIONS

| | | | |
|---|---|---|---|
| 209,418 | 6/1960 | Germany | 323/60 |

OTHER PUBLICATIONS (SZ6540008) IEEE Transactions on Magnetics, Sept. 1971, pp. 564–567.

"Closed-Loop Controlled Ferroresonant Regulator" by Higuchi et al., IBM Tech. Disc. Bull., vol. 17, No. 9, Feb. 1975, pp. 2736, 2737.

*Primary Examiner*—Gerald Goldberg

*Attorney, Agent, or Firm*—Johnson, Dienner, Emrich & Wagner

[57] ABSTRACT

A thyristor controlled ferroresonant voltage regulator in which the output voltage is made adjustable by varying the reset flux level of each of two parallel magnetic core paths upon which the load windings are wound. Decoupling from the alternating current source is provided by a separate inductor. The two core paths are decoupled by magnetic shunts, which provides an inductance which may be designed to obtain a soft commutation characteristic for the ferroresonant capacitor. During one half cycle of the output waveform one thyristor is enabled by an associated control circuit to complete a circuit path for the resonant capacitor through a winding on the second magnetic core path, while the flux in the first magnetic core path is clamped; in the second half cycle, another thyristor is enabled at a time determined by the control circuit, to complete a circuit path for the capacitor through a winding on the first magnetic core path while the flux in the second magnetic core path is clamped.

17 Claims, 5 Drawing Figures

VARIABLE FLUX-RESET FERRORESONANT VOLTAGE REGULATOR

BACKGROUND OF THE INVENTION

This invention relates to ferroresonant voltage regulating circuits, and particularly to circuits of such type which have an adjustable output voltage or closed feedback loops.

Ferroresonant regulators presently find widespread use in the power supply field. Among the many advantages of such type regulator is the fact that it is a regulating transformer circuit which provides voltage isolation and allows setting of the output voltage level. In addition, such type of regulator is reliable, of relatively low cost, simple in structure and of small size, provides excellent voltage regulation with static and dynamic input line voltage changes, has inherent short circuit protection, has good efficiency and input power factors, has output characteristics which protect rectifiers, requires a smaller filter than for other types of sources, and has multiple output capability. Summarily the ferroresonant regulator power supply is the simplest, lowest cost, and most reliable power supply available today for producing large amounts of regulated DC or AC power from an AC source.

Ferroresonant voltage regulators basically include a linear inductor, a saturating inductor, more commonly called a saturating reactor, and a capacitor. The linear inductor is in series with the input line to the voltage regulator and the saturating reactor shunts the output. The capacitor, often called a ferroresonating capacitor, or more simply a ferrocapacitor, shunts the saturating reactor and is usually tuned near resonance with the linear inductor. Both the linear inductor and the saturating reactor may be wound on a single transformer core with the input and output electrically isolated, in which case, the input winding is on a non-saturating portion of the transformer core and the output winding is on a saturating portion. In each half cycle of AC input the saturating core saturates, and the impedance of the saturating winding drops. The capacitor resonates with the low, saturated inductance to quickly discharge the saturating winding and recharge in the opposite polarity. The core thereupon drops out of saturation so that further ringing does not occur. The AC output, which may be rectified to provide DC output, is taken from across the ferrocapacitor. When the ferrocapacitor voltage reverses, therefore, the output voltage reverses and the output half cycle is terminated. A saturating core, however, requires a fixed volt-time area of its saturating winding characteristic in order to saturate. Consequently, when the input voltage increases or decreases, the core saturates earlier or later in the immediate half cycle, but the volt-time product of each half cycle of output voltage is constant. When the input frequency is constant, therefore, providing a constant steady state volt-time average per output half cycle, the output voltage must be constant. As a result, changes in input voltage have little effect on output voltage and regulation against changes in input voltage is obtained thereby.

For a given design, it is well known that the output voltage is directly proportional to the source frequency since the volt-time area across the core is held constant. It is also well known that the output voltage changes with temperature because the saturation flux density is temperature dependent. Also, the impedances in the load winding and load circuit cause changes in the output voltage when the load current is changed. Manufacturing tolerances in the transformer circuit and tolerances in the saturation flux density of the magnetic core material cause changes in the output voltage for a fixed design. There is no convenient way of adjusting the output voltage or controlling the output voltage to correct for variables once the design has been made.

Many methods have been applied in an attempt to provide some degree of adjust or control in the ferroresonant regulator field. Some prior methods are mentioned in my U.S. Pat. No. 3,739,257 issued June 12, 1973 and assigned to North Electric Company, Galion, Ohio. That patent also discloses a variable flux-reset ferroresonant voltage regulator having simplified adjustment or control type capabilities, and which further has improved output regulating characteristics. The structure comprises a single transformer or magnetic component having two separate saturating core portions both decoupled from the source by separate magnetic shunt means, with the ferroresonant capacitor coupled across windings on both of the saturating portions. The circuit is thyristor controlled with a separate thyristor across the winding of each saturating core portion, one thyristor being enabled by a control circuit during the first half cycle to connect the capacitor in series with the other saturating core portion to resonately discharge and reverse charge the capacitor, and the other thyristor is selectively enabled during the other half cycle. The patent discloses a thyristor controlled ferroresonant voltage regulator circuit in which the output voltage is made adjustable by varying the reset level of each of two parallel magnetic core paths upon which the load windings are wound. One magnetic core path is driven hard into magnetic saturation during one half cycle of the output waveform, and the second magnetic core path is clamped at a given value; in the second half cycle the second path is driven into magnetic saturation and the one path is clamped at the given value. The level of clamping is determined by an associated control circuit which may comprise a simple manually adjustable potential source, or a circuit with load sensing and automatic feedback capabilities.

The ferrocapacitor is discharged at the end of each half cycle of the output voltage and recharged in the opposite polarity. The characteristics of the resonant discharge and recharge is determined by the shape of the B-H characteristic. For high quality grain-oriented silicon steel, the magnetic saturation region is very flat requiring a large magnetizing force to change the flux a small amount. This results in a very low impedance across the windings on the two saturating core portions when the core enters the saturation region. The resultant discharge current in the ferroresonant capacitor has a very high peak value and short duration.

SUMMARY OF THE INVENTION

An object of the invention is to provide a softer commutation characteristic of the resonant capacitor in a variable flux reset ferrosonant voltge regulator. Another object is to obtain improved efficiency as a result of the softer commutation. Still another object is to provide an approach with additional design freedom in the magnetic shunt areas of the saturating core structure.

According to the invention, the two separate saturating core portions of a variable flux reset ferroresonant voltage regulator are decoupled from one another, by means separate from the decoupling of the alternating current source from the load. In an embodiment of the invention, the two core portions are decoupled by magnetic shunts between the two portions. The decoupling from the alternating current source is preferably provided by a separate series inductor, and the primary winding then has a part of each of the two core portions tightly coupled to the other windings on the same core portion.

The magnetic shunts between the two core portions provide an inductance which may be designed to provide a softer commutation characteristic of the resonant capacitor.

DETAILED DESCRIPTION

The invention is incorporated in a circuit of the type described in my U.S. Pat. No. 3,739,257 issued June 12, 1973 for a Variable Flux Reset Ferroresonant Voltage Regulator, which is incorporated herein and made a part hereof as though fully set forth, and hereinafter referred to as the reference patent.

Figure 1:
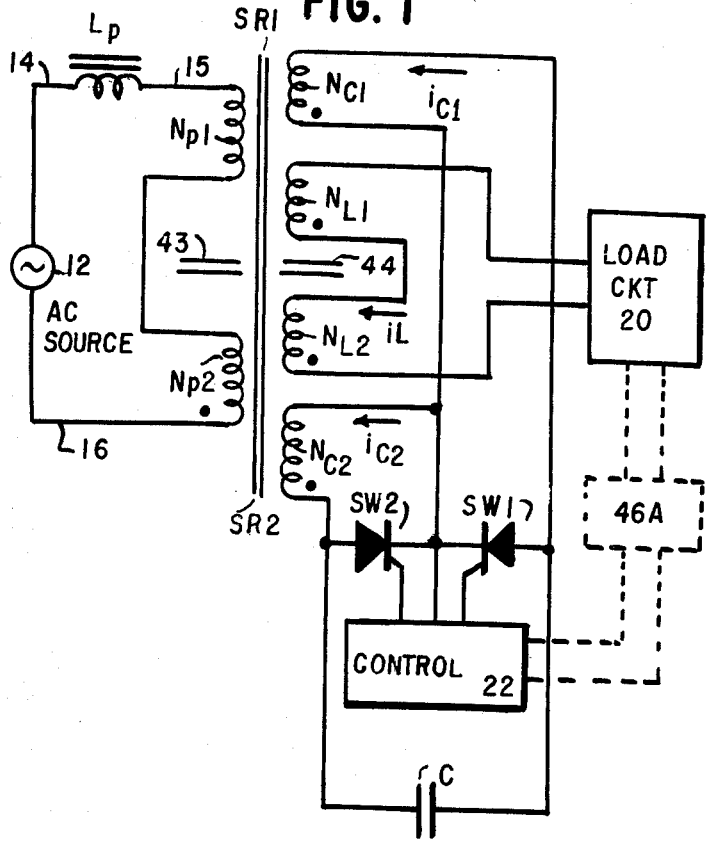
FIG. 1 is a schematic showing a circuit including a regulator structure according to the inventive concept.
Figure 2:
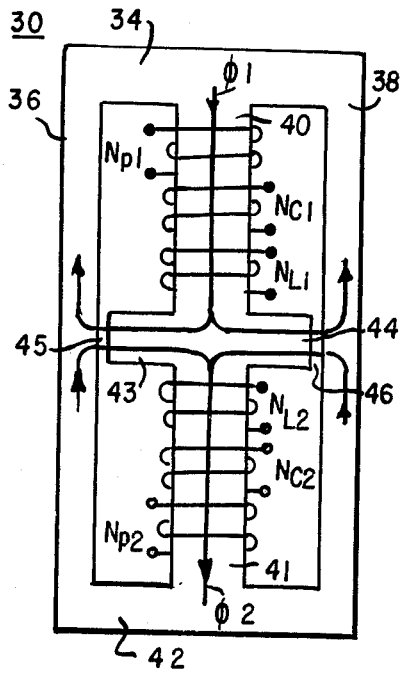
FIG. 2 shows the core structure and windings of the circuit of FIG. 1.

FIGS. 1 and 2 comprise an illustrative embodiment of the invention.

With reference to FIG. 2, such regulator is shown to comprise a one piece transformer structure 30 comprising a three legged core of stacked iron laminations. In the illustrated embodiment, conventional E configuration laminations are disposed to provide an upper transverse leg 34, vertical side legs 36, 38 and a vertical center leg having an upper portion 40 and a lower portion 41. I-shaped laminations are disposed to abut and span in one end of the E shaped laminations so as to provide lower transverse leg 42. The E-I laminations are interleaved in known manner to form the illustrated structure.

Magnetic shunts 43, 44 are located in spaced relationship on the center vertical leg between the upper portion 40 and lower portion 41 with the ends thereof located in spaced adjacent relation to vertical legs 36, 38 to provide air gaps 45, 46 respectively.

Primary windings $N_{p1}$ and $N_{p2}$ are wound respectively on the upper and lower portions of the 40, 41 center leg. A secondary coil structure consisting of capacitor winding $N_{C1}$ and a load winding $N_{L1}$ are wound on the upper portion 40 of the center leg. A second capacitor winding $N_{C2}$ and a second load winding $N_{L2}$ are wound on the lower portion 41 of the center leg.

With reference to FIG. 1, the load windings $N_{L1}$, $N_{L2}$ are connected in series to load circuit 20 and the capacitor windings $N_{C1}$, $N_{C2}$ are connected in series across resonating capacitor C. Thyristors SW1 and SW2 are connected across capacitor windings $N_{C1}$ and $N_{C2}$. Control circuit 22 (and a feedback circuit 46A if desired) are connected to control the thyristors SW1 and SW2.

A separate linear inductor $L_P$ provides decoupling between an A.C. source 12 and the load circuit 20. The circuit from the A.C. source 12 extends via conductor 14 through the inductor $L_p$ to conductor 16, thence via windings $N_{p1}$ and $N_{p2}$ in series and conductor 16 back to source 12.

Note that windings $N_{p1}$, $N_{c1}$ and $N_{L1}$ are tightly coupled, and also that windings $N_{p2}$, $N_{C2}$ and $N_{L2}$ are tightly coupled, but that these two sets of windings are decoupled via the magnetic shunt 44. As shown in FIG. 2, a flux $\phi 1$ flows in the upper portion 40 and the shunts 43, 44, while a flux $\phi 2$ flows in the lower portion 41 and shunts 43, 44.

If it is assumed that the thyristors are nonconducting, the circuit behaves as a conventional ferroresonant circuit where the center leg saturates once in each half cycle of the output waveform to resonantly discharge capacitor C.

Figure 3:
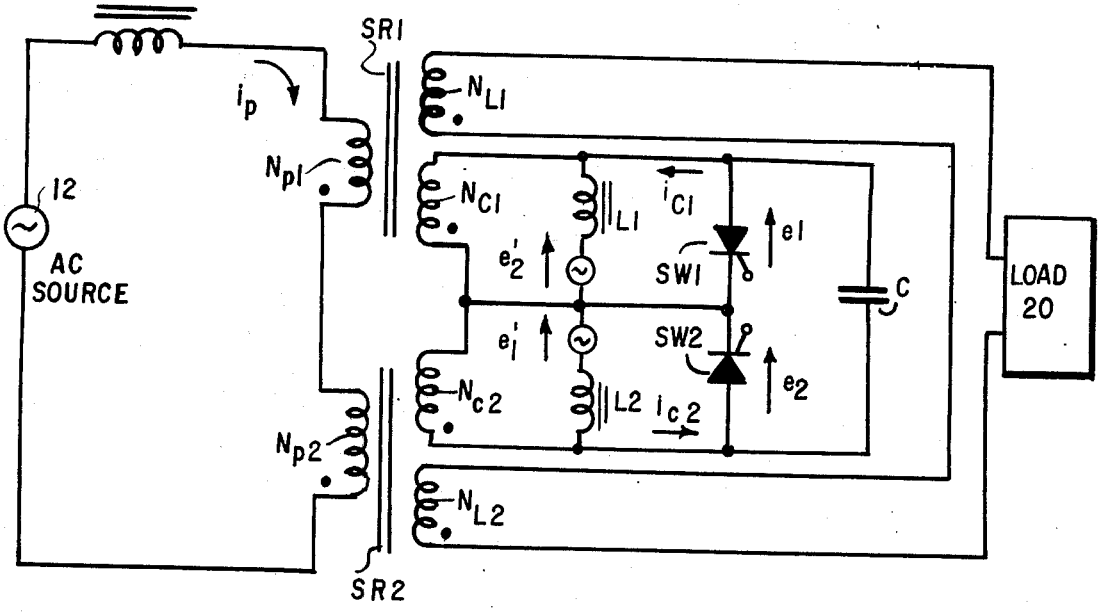
FIG. 3 is a diagram showing an equivalent circuit of the structure of FIGS. 1 and 2.

To derive an equivalent circuit as shown in FIG. 3, let Rs be the effective reluctance of the shunt path, R1 be the effective reluctance of the magnetic path where $\phi 1$ flows other than the shunt, and R2 be the reluctance of the magnetic path where $\phi 2$ flows other than the shunt.

Then with reference to the resonant capacitor circuit:

$$N_{c2}\, i_{c2} + N_{L2}\, i_L + N_{p2}\, ip = R2\ \phi 2 + \mathrm{Rs}\ (\phi 2 - \phi 1)$$

$$N_{c1}\, i_{c1} + \mathrm{N}_{L1}\, i_L + \mathrm{N}_{p1}\, ip = R1\ \phi 1 + \mathrm{Rs}\ (\phi 1 - \phi 2)$$

The equivalent circuit is derived by differentiating the above equations, where we $$\text{Let } e_1 = N_{c1}\ (d\phi 1/dt),\ e_2 = N_{c2}\ (d\phi 2/dt).$$

so that $$L1 = N_{c1}^2 / (R1 + (R1 + Rs), \text{ and}$$

$$\mathrm{L2} = N_{c2}^2 / (R2 + Rs)$$

As shown by the resultant equivalent circuit in FIG. 3, effective inductances, L1 and L2, are connected across the resonant capacitor C by the thyristor conduction at a prescribed time in each half cycle to effectively control the discharge of capacitor C. Since these inductances are determined by the reluctance R1 + Rs and R2 + Rs, a number of design freedoms result. Rs can be controlled by the shunt design and air gap. If the air gaps 45 and 46 are made very small Rs is highly nonlinear as a function of magnetomotive force. In this case either the center leg or shunt would saturate to resonantly discharge the resonant capacitor. The transition of the iron from the nonsaturated to saturated state is usually quite abrupt and the effective inductance becomes quite low. This results in high peak currents where C is discharged very rapidly.

By introducing air gaps as shown in FIG. 2 the inductances L1 and L2 can be made to be more a function of the gap and less a function of the iron characteristics. L1 and L2 can be controlled to achieve the desired discharge characteristic. In this case it is usually desired to have an inductance which causes a softer discharge characteristic, one which results in lower peak currents and longer discharge times.

OPERATION

The magnetic circuit of the arrangement shown in FIGS. 1 and 2 consists of two magnetic paths through which flux $\phi_1$ and $\phi_2$ can flow independently of each other, and independently of the alternating current source 12. Flux values $\phi_1$ and $\phi_2$ are controlled by the secondary circuit which consists of the resonant capacitor C, thyristors SW1, SW2 and the associated control circuit 22, and capacitor windings $N_{c1}$ and $N_{c2}$. The difference between flux values $\phi_1$ and $\phi_2$ is forced to flow over the magnetic shunts 43,44.

With the thyristors SW1 and SW2 in a nonconducting state, the regulator circuit functions in a manner similar to a conventional ferroresonant regulator, wherein the secondary windings, such as $N_{L1}$, $n_{L2}$, of two ferroresonant transformer circuits are connected in series. The flux-density values $B_1$ and $B_2(\phi 1/A$ and $\phi 2/A)$ vary over the limits shown in FIG. 15 of the reference patent of $-B_{1s}$ to $+B_{1s}$ for core SR1 and $-B_{2s}$ to $+B_{2s}$ for core SR2.

The resultant output voltage is proportional to the sum of the flux-density changes $2B_1$s and $2B_{2s}$ in each core. Each core is driven hard into magnetic saturation once in each half-cycle. By controlling the interval of firing of thyristor SW1 and SW2 in each half cycle the flux changes in each core can be varied.

It is initially assumed that at some time in the half-cycle of the output waveform, when the dotted terminals are positive, both thyristors SW1, SW2 are nonconducting, and that the flux-density in each core portion SR1, Sr2 is increasing in a positive direction. When the flux-density in core portion SR2 reaches the value $+B_{2R}$, thyristor SW2 is gated into conduction which effectively short circuits winding $N_{c2}$ and clamps the flux density at that value. No further flux change in core portion $SR_2$ is possible while thyristor SW2 is conducting; however, the flux-density in core portion $Sr_1$ is increasing toward positive saturation and a maximum value $+B_{1s}$.

The resonant capacitor C discharges through the circuit path consisting of thyristor SW2 and winding $N_{cl}$, due to the effective inductance L1. The voltage of capacitor C thereupon reverses polarity and charges to a large negative voltage. When the current in thyristor SW2 goes to zero, it becomes nonconducting. The flux-density in core portion SR2, as a result, starts to change in a negative direction.

At some later time in the negative half-cycle thyristor SW1 is gated into conduction, which effectively short circuits winding $N_{c1}$ and clamps the flux-density at a value $-B_{1R}$. The flux-density in core region SR2 continues to change toward negative saturation and a maximum value $-B_{2s}$. The resonant capacitor C discharges through the circuit path consisting of thyristor SW1 and winding $N_{c2}$ due to the effective inductance L2. The voltage of capacitor C reverses polarity and charges to a large positive voltage. When the current in thyristor SW1 goes to zero, thyristor SW1 becomes nonconducting. One complete cycle has now been completed.

The total load voltage $e_L$ and the resonant capacitor voltage $c_c$ are waveforms identical to the conventional ferroresonant regulator waveforms.

The resonant capacitor C and thyristor circuit including thyristors SW1, SW2 are shown directly coupled in the embodiment shown in FIG. 1. However, as shown in FIG. 16 of the reference patent, the resonant capacitor C may be inductively coupled to the thyristors SW1, SW2. The capacitor windings may also be made common with the primary windings in order to achieve better utilization of copper in the transformer. Control of the firing of thyristors can be achieved with any of the modes shown in the reference patent.

In the circuit as described above, the capacitor C is discharged near the end of each half-cycle of the output voltage and recharged in the opposite polarity. The characteristics of the resonant discharge and recharge is determined by the shape of the B-H characteristic shown in FIG. 15 of the reference patent, and the effective inductances L1 and L2. For high quality grain-oriented silicon steel, the magnetic saturation region is very flat requiring a large magnetizing force to change the flux a small amount. This results in a very low impedance across windings $N_{c1}$ and $N_{c2}$ if the core is permitted to enter the saturation region, in which case the resultant discharge current in capacitor C has a very high peak value and short duration. With the resultant high peak currents the RMS currents are high in the capacitor and windings $N_{c1}$, $N_{c2}$. By designing the magnetic shunts to provide values of inductance L1 and L2 which soften the resonant discharge, the peak current is reduced, and the RMS value of the current is therefore reduced. This decreases circuit losses and results in more stable operation.

Note that the adjustment of the shunt path 43,44 in no way affects the coupling of the alternating current source 12 and the windings. This is significant since it gives independent design control. The inductive decoupling provided by the shunt path 43,44 is used to determine the commutation characteristic for the resonant discharge and reverse charging of the ferrores onant capacitor — this adds a degree of freedom in design. The separate inductor $L_p$ replaces the magnetic shunt used in prior circuits such as in the reference patent, for decoupling the alternating current source from the load.

It is necessary to provide a large amount of decoupling so that the secondary can regulate and resonate with the ferrocapacitor independent of the source. Stated in another manner, the present arrangement controls the resonant discharge path by adjustment in the design of the air gaps of the magnetic shunts independent of the coupling inductance $L_p$ which decouples the source from the load.

With the circuit designed to provide inductance L1 and L2 values which result in a lower rate of discharge of the ferrocapacitor, and to prevent the core from going into high saturation, there is less loss and less noise. The circuit operates at lower RMS current values to reduce the losses and heat problems. In the circuits of the reference patent there is no control of the saturation of the center leg. Resonance in the secondary circuit is determined by the core B-H characteristics and the relative inductance of the shunt paths which provide the decoupling between the source and the secondary windings. There is frequently a restriction in the choice of laminations that can be used to effect the prior designs. The present arrangement permits the use of different size and types of laminations, since a final design adjustment can be made to the gap of the magnetic shunt. Other features include the ability to attain higher power using the same laminations, improved efficiency in the center leg, and an improved cost factor in manufacture.

Typical Embodiment

Figure 4:
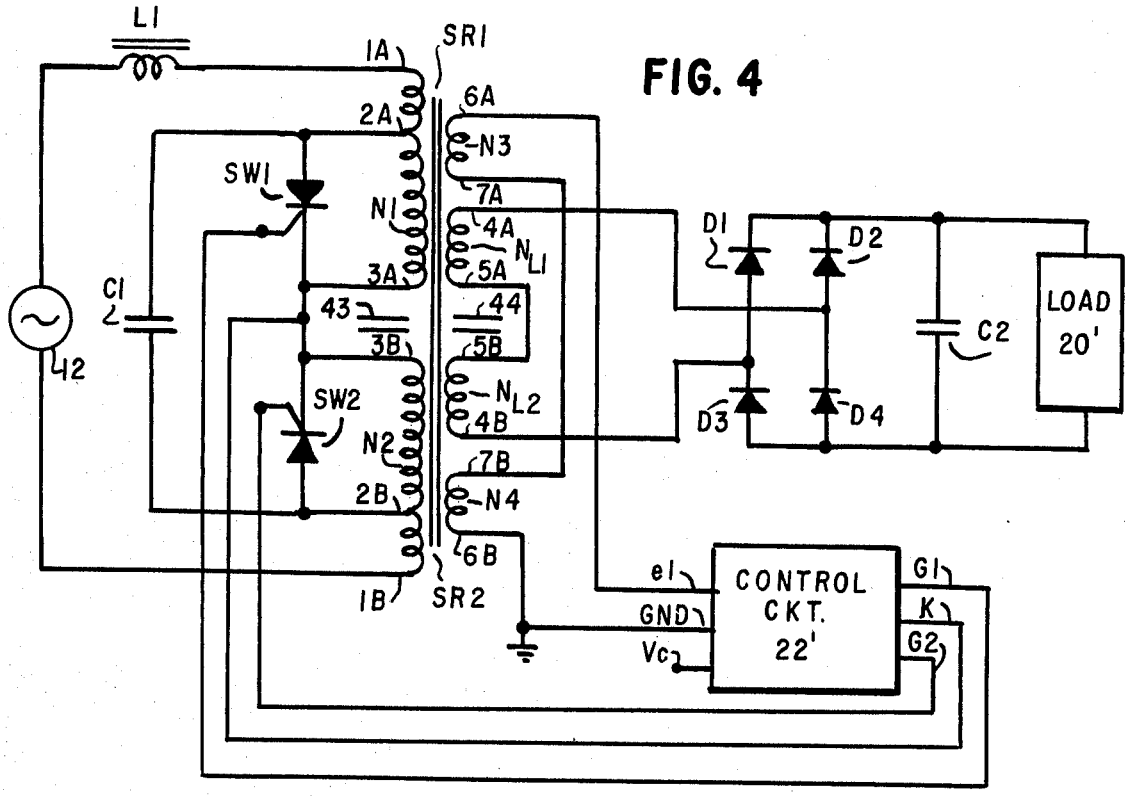
FIG. 4 is a schematic showing a typical embodiment of a circuit with a regulator structure according to the inventive concept.
Figure 5:
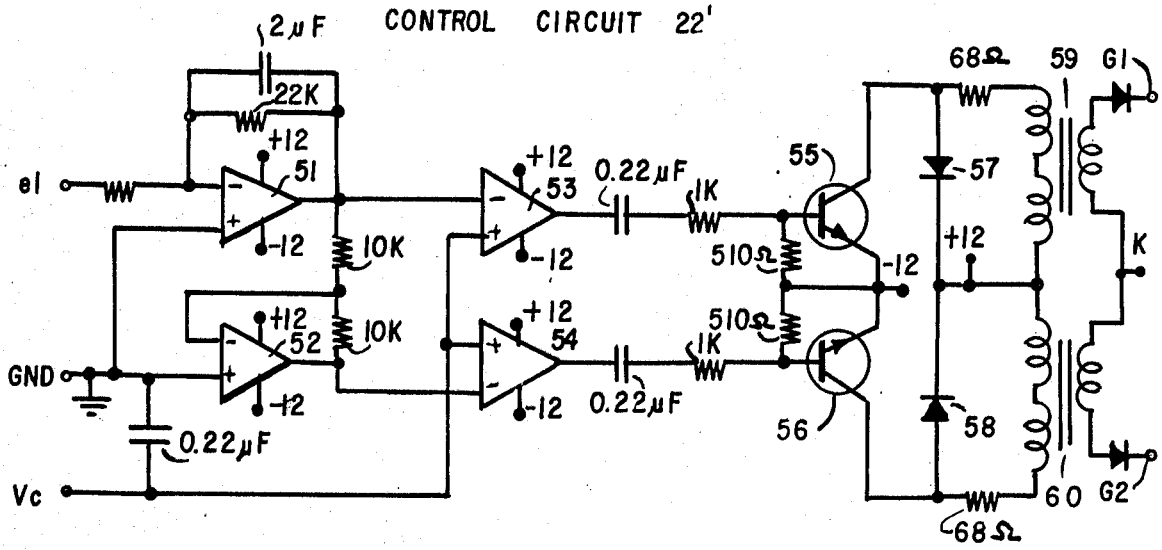
FIG. 5 is a schematic of a control circuit used with the circuit of FIG. 4.

A regulator circuit as shown in FIG. 4 was tested with the control circuit 22' shown in FIG. 5. The primary and capacitor circuits are both connected to windings N1 and N2 connected in series at ends 3A and 3B. The primary winding from end 1A of N1 to end 1B of N2 has 126 turns total, and the capacitor winding from tap 2A of N1 to tap 2B of N2 has 106 turns total. The inductor L1 connected in series in the primary circuit between the alternating current source 12 and winding end 1A has an inductance of 59.8 millihenries. The ferrocapacitor C1 connected between taps 2A and 2B has a value of 105 microfarads. The thyristors SW1 and SW2 connected across the capacitor part of windings N1 and N2 respectively may be type C50N available from General Electric Company.

The load windings $N_{L1}$ and $N_{L2}$ connected in series at ends 5A and 5B have a total of 30 turns. In the load circuit, a rectifier bridge comprises four diodes D1, D2, D3, D4 which may by type 1N3290. The A.C. input terminals of the bridge is connected between ends 4A and 4B of the load windings. Across the output terminals of the bridge there is a 54,000 microfarad filter capacitor C2 and a resistive load 20'. The full load direct current rated output is 154 volts at 67 amperes. The input is nominally 480 volts at a frequency of 60 Hz, with a range of 424–508 volts at 57–63 Hz.

Control windings N3 and N4 having a total of 10 turns are connected is series at ends 7A and 7B. The end 6A of N3 is connected to input $e_1$ of control circuit 22' and the end CB of N4 is connected to the grounded input GND.

The control circuit as shown in FIG. 5 comprises four amplifiers 51, 52, 53, 54 which may be type 747; and two transistors 55,56 which may be type 2N1893. The input at terminal $V_c$ is a direct current control voltage for a setting to determine the value of the load voltage. The output of the control circuit is coupled via transformers 59 and 60 to leads G1 and G2 to the gate electrodes of thyristors SW1 and SW2 respectively, with a connection to lead K to the common connection for the cathode electrodes. The control circuit 22' also includes resistors and capacitors with values as shown. There are bias connections to +12 and −12 volts D.C. as shown.

In the regulator transformer, the core portions SR1 and SR2 and shunts 43, 44 are designed so that with thyristors SW1 and SW2 non conducting the output voltage rises to approximately, 175–180 volts under load.

The short circuit current is approximately 67 amperes.

At full load of 154 volts, 67 amperes D.C., with the input at 480 volts, the input current is 25.4 amperes R.M.S. and the input power is 11,250 watts. This results in an efficiency of 91.7 percent, and a power factor of 91.0 percent. The voltage across the ferrocapacitor C1 is 563 volts R.M.S. At low input of 420 volts, the input current is 29.4 amperes and the capacitor voltage is 546 volts. At high input of 508 volts, the input current is 23.9 amperes, and the capacitor voltage is 569 volts. The load voltage and current and input power do not vary substantially with changes of input voltage. As the load current is reduced the D.C. voltage remains at substantially 154 volts to load current values less than 1 ampere.

What is claimed is:

1. A regulator device comprising a transformer structure having magnetic core means which has at least a first and second magnetic path, primary winding means having first and second predetermined portions thereof respectively wound on said first and second magnetic paths of said magnetic core means, secondary winding means wound on said magnetic core means including load winding means having first and second predetermined portions thereof respectively wound on said first and second magnetic paths for providing an output voltage to a load which is proportional to the rate of change of flux in said first and second magnetic paths, means for connecting said primary winding means to an alternating current source including first decoupling means for decoupling said source from said load, a first capacitor winding wound on said first magnetic path and a second capacitor winding wound on said second magnetic path, capacitor means, second decoupling means for decoupling said first capacitor winding from said second capacitor winding, and switching means operative at a selected time in a first half cycle of the load voltage to couple said capacitor means across said first capacitor winding, and operative at a selected time in a second half cycle of the load voltage to couple said capacitor means across said second capacitor winding, to effect resonant commutation to reverse the charge of said capacitor means in each half cycle, the characteristic of said resonant commutation being independently controlled by the design of said second decoupling means.

2. A regulator device as set forth in claim 1, wherein said first decoupling means comprises inductor means separate from said transformer structure and connected in series between said primary winding means and said alternating current source.

3. A regulator device as set forth in claim 2, wherein said switching means includes first and second switch devices connected respectively across said first and second capacitor windings, and control means for selectively enabling said first and second switch devices at selected variable times in said first and second half cycles respectively.

4. A regulator device as set forth in claim 2, wherein said second decoupling means comprises magnetic shunt means on said transformer structure between said first and second magnetic paths.

5. A regulator device as set forth in claim 4, wherein said first and second predetermined portions of said primary winding means are connected in series, and wherein said first predetermined portion of said primary, said first predetermined portion of said load and said first capacitor windings on said first magnetic path are tightly coupled, and said second predetermined portion of said primary, said second predetermined portion of said load and said second capacitor windings on said second magnetic path are tightly coupled.

6. A regulator device as set forth in claim 4, including control means to enable said switching means at selected times in said first and second half cycles such that no part of said magnetic core means is driven into hard saturation.

7. A regulator device as set forth in claim 6, wherein said magnetic shunt means along with said first and second magnetic paths and said first and second capacitor windings provide a relatively large effective inductance after said switching means is enabled in said first and second half cycles so that said characteristic comprises current flow in said capacitor means for a relatively long interval with a relatively low peak value compared to that which would occur with hard magnetic saturation of said magnetic core means.

8. A regulator device as set forth in claim 1, wherein said second decoupling means along with said first and second magnetic paths and said first and second capacitor windings provide a relatively large effective inductance after said switching means is enabled in said first and second half cycles so that said characteristic comprises current flow in said capacitor means for a relatively long interval with a relatively low peak value compared to that which would occur with hard magnetic saturation of said magnetic core means.

9. A regulator device comprising a transformer structure having magnetic core means which has a first and a second magnetic path, a first winding means wound on said first magnetic core path and a second winding means wound on said second magnetic core path, magnetic shunt means decoupling said first winding means from said second winding means, capacitor means; said first and second winding means each including primary winding means, a load winding means for connection of an output voltage to a load, and a capacitor winding means; input decoupling means for connection of said primary winding means to an alternating current source for decoupling said source from said load, switching means operative at a selected time in a first half cycle of the output voltage to effectively shunt said first winding means to clamp the flux in said first magnetic path at a selected level and to connect said capacitor means to said capacitor winding means for said second winding means, thereby driving the flux in said second magnetic path to flow via said magnetic shunt means providing an effective inductance to resonantly discharge and reverse charge said capacitor means, the characteristics of the resonant commutation being independently controlled by the design of said magnetic shunt means, said switching means being operative in a second half cycle of the output voltage to effectively shunt said second winding means to clamp the flux in said second magnetic path at a selected level and to connect said capacitor means to said capacitor winding means for said first winding means, thereby driving the flux in said first magnetic path to flow via said magnetic shunt means providing an effective inductance to resonantly dishcarge and reverse charge said capacitor means.

10. A regulator device as set forth in claim 9, wherein said input decoupling means comprises inductor means separate from said transformer structure connected in series to said alternating current source.

11. A regulator device as set forth in claim 10, wherein said first winding means and said second winding means each comprise a plurality of windings tightly coupled.

12. A regulator device as set forth in claim 11, wherein said primary winding means and said capacitor winding means for said first winding means and said second winding means include at least some common turns of said first winding means connected in series with at least some common turns of said second winding means, and said load winding means comprises a winding of said first winding means connected in series with a winding of said second winding means.

13. A regulator device as set forth in claim 11, wherein said effective inductance to resonantly discharge and reverse charge said capacitor means has a relatively large value so that current flows in said capacitor means for a relatively long interval with a relatively low peak value compared to that which would occur with hard magnetic saturation of said magnetic core means.

14. A regulator device comprising a transformer structure having a magnetic core which has a center leg with first and second sections over which respectively first and second magnetic paths are established, magnetic shunt means between said first and second sections for decoupling said first and second magnetic paths, first and second winding means wound on said center leg of said first and second sections respectively, inductance means, said first and second winding means including first means for connection in series with said inductance means to an alternating current source, second means for connection of an output voltage to a load which output voltage is proportional to the rate of change of flux in said first and second paths, said inductance means decoupling said source from said load, said first winding means further including a first capacitor winding, said second winding means further including a second capacitor winding, capacitor means coupled across said first and a second capacitor windings, switching means including a first switch means coupled across said first capacitor winding to control current conduction from said capacitor means over said second capacitor winding to drive the flux of said second magnetic path to flow via said magnetic shunt means and to substantially clamp the flux level in said first magnetic path at a selected level which varies with and is determined by the time in a first half cycle of the output voltage at which said first switch means is enabled, and a second switch means coupled across said second capacitor winding to control current conduction from said capacitor means over said first capacitor winding to drive the flux of said first magnetic path to flow via said magnetic shunt means and to substantially clamp the flux level in said second magnetic path at a selected level which is determined by and varies with the time in a second half cycle of the output voltage at which said second switch means is enabled, and control means for selectively enabling said first and second switch means in alternate half cycles; to effect resonant commutation to reverse the charge of said capacitor means in each half cycle, the characteristic of said resonant commutation being independently controlled by the design of said magnetic shunt means.

15. A regulator device as set forth in claim 14, wherein said first winding means and said second winding means each comprise a plurality of windings tightly coupled.

16. A regulator device as set forth in claim 15, wherein said characteristic comprises a relatively slow rate with a relatively low peak current value for said resonant commutation compared to that which would occur with hard magnetic saturation of said magnetic core.

17. A regulator device as set forth in claim 15, wherein said first and second winding means respectively further include first and second control windings in series, said control means having input connections to said first and second control windings and output connections to enagle said first and second switch means at selected times in said first and second half cycles.

* * * * *